United States Patent [19]

Keutgen et al.

[11] Patent Number: 4,911,224

[45] Date of Patent: Mar. 27, 1990

[54] EXTRACTING HORIZONTAL CASTINGS

[75] Inventors: Franz Keutgen, Lissendorf; Dieter Perings, Buedesheim; Achim Kubon, Neukirchen-Vluyn; Voss-Spilker, Kempen, all of Fed. Rep. of Germany

[73] Assignee: Mannesmann AG, Duesseldorf, Fed. Rep. of Germany

[21] Appl. No.: 157,102

[22] Filed: Feb. 9, 1988

Related U.S. Application Data

[63] Continuation of Ser. No. 893,631, Aug. 6, 1986, abandoned.

[30] Foreign Application Priority Data

Aug. 7, 1985 [DE] Fed. Rep. of Germany ..... 3528328

[51] Int. Cl.[4] ..... B22D 11/128

[52] U.S. Cl. ..... 164/454; 164/478; 164/490; 164/484

[58] Field of Search ..... 164/454, 413, 478, 484, 164/416, 441, 442, 490, 440

[56] References Cited

U.S. PATENT DOCUMENTS 3,563,297 2/1971 Wertli ..... 164/484

*Primary Examiner*—Kuang Y. Lin
*Attorney, Agent, or Firm*—Ralf H. Siegemund

[57] ABSTRACT

A casting is extracted from a horizontal mold by means of extraction cycles with a shallow speed rise followed by a steep one, followed by a constant speed phase, followed by a rapid slowdown, and brief reversal. The casting is held by brackets which operate from above and below with separate bracket drives but parallel axes of action.

4 Claims, 3 Drawing Sheets

15
15b
15a
14c
14
14b
23a
14a
18a
13a
18d
12
16
16a
19
19a
17
18
13b
20
14d
11
14e
18b

EXTRACTING HORIZONTAL CASTINGS

This application i a continuation of parent application, Ser. No. 893,631, filed Aug. 06, 1986, now abandoned.

BACKGROUND OF THE INVENTION

The present invention relates to the extraction of castings from a mold for horizontal continuous casting of metal, particularly steel, whereby particularly the casting is extracted in steps, each extraction step being succeeded by a slight retraction step and holding periods are respectively interposed in between. A retraction step and the next extraction step together may last from about 0.01 sec to a maximum duration of about half a second for the holding period.

Generally speaking, horizontal continuous casting of this kind is known through the Rexroth Information Quarterly, June issue 1985, pages 32 and 33. Such horizontal casting of metal, e.g. of steel, in this name requires that the casting strand be extracted, i.e. pulled out of the mold, because the process of casting withdrawal is not aided by gravity. During and following each extraction step, molten metal flows into that part of the mold which has just been vacated by a portion of the stepwise extracted and (partially) solidified casting. This flow of molten metal is dependent upon the extraction generally but in addition, the flow is determined by the inertia, viscosity and other parameters of the flowing metal itself. In particular then, a fast extraction of the casting does not immediately and directly entail a fast flow of molten metal into the vacated space, but inertia and viscosity impart a certain sluggishness upon the molten metal. It has been observed that cavities, for example, may form between, so to speak, the end of that portion of the casting that is being extracted, and the following metal as it flows into the mold. Therefore, it was the practice in the past that the extraction process during horizontal continuous casting had to match flow dynamics of the molten metal so the speed of an extraction stroke and so the cycle time of extraction in order to avoid the formation of cavities.

Specific extraction strokes and/or speeds attained by an extraction device can be provided with certainty only if at the same time the clamping force exerted upon the casting strand by the extraction device through clamping brackets or the like is appropriately determined. An adjustment of the clamping force is required, so as to inter alia match the operation of the clamping device to the format of the strand. In addition, in the case of an impending danger of interference a maximum clamping force can be exerted, for example, independent from the adjustment and from any matching of clamping to normal extracting conditions.

DESCRIPTION OF THE INVENTION

It is an object of the present invention to match extraction strokes and clamping force during continuous casting to the requisite extraction process as a whole such that the casting is clamped and held with certainty under conditions which damages the surface as little as possible. Moreover, a specific adjustment is to be carried out tuning that the extraction path is matched to the extraction speed under consideration of the aforementioned flow dynamics of molten metal.

In accordance with the preferred embodiment of the present invention, it is suggested to modify and particularize an extraction process in which extractions and (slight) retractions alternate and wherein holding periods are interposed; the extraction acceleration phase which is followed by a constant speed phase which, in turn, is followed by a controlled retardation phase; the cycle time lasts at least 0.15 sec and at the most 1.0 sec. These parameters, namely acceleration, constant speed phase and retardation are adjusted and thus permit adjustment of the extraction path length in relation to the extraction speed, to thereby limit the cycle time as a whole; the extraction must be adjustable in steps of 0.1 mm. Upon using such a velocity profile, the clamping force can now be significantly reduced to thereby minimize danger of damage to the strand surface. The equipment used for practicing the invention, includes preferably clamping facilities which reciprocate in the same direction, as well as opposite thereto, as strand extraction takes place. Moreover, the extraction of the casting can be matched readily to the actual conditions under which metal flows into vacated mold portions. The longitudinal displacement of the clamping device should cover at least the length of three extraction strokes, so that the extraction cycles can be covered by one bracket pair being in clamping position; a second one or possibly a third bracket undergo return motion. Two bracket pairs are preferred.

The clamping devices each include hydraulic cylinder piston units for operating pairs of clamping brackets in unison or individually. A reduced clamping force is provided for purposes of reducing damage to the surface of the casting. Here then process parameters are controllable more easily if the clamping brackets are arranged such that at least one pair of the brackets face each other in a vertical direction. For example, for purposes of a format change, while both brackets together will simultaneously be moved in order to distinguish between clamping and release situations. Arranging the clamping brackets and pairs in the vertical is of advantage for space saving. Saving sapce is an important feature in case of multiple strand casting. The upper bracket is generally movable between varied different vertical level heights, while the lower clamping bracket will be adjusted as to its vertical elevation just to the extent needed in order to distinguish between clamping-holding and release molds of operation.

In furtherance of the invention, the two clamping brackets of a pair are separately controlled through separate piston cylinder arrangements which differe generally by the length of the stroke. The lower bracket should be adjusted through its piston cylinder drive to abut a stationary stop being oriented particularly with respect to other clamps of the unit to maintain a datum plane for the strand. The various piston cylinder drives should have their respective axes arranged in parallel which is also of advantage for multiple strand machines. The opening displacement of the brackets should be tracked, particularly for limiting its extension.

DESCRIPTION OF THE DRAWINGS

While the specification concludes with claims particularly pointing out and distinctly claiming the subject matter which is regarded as the invention, it is believed that the invention, the objects, and features of the invention, and further objects, features, and advantages thereof will be better understood from the following description taken in connection with the accompanying drawings in which:

Figure 1:
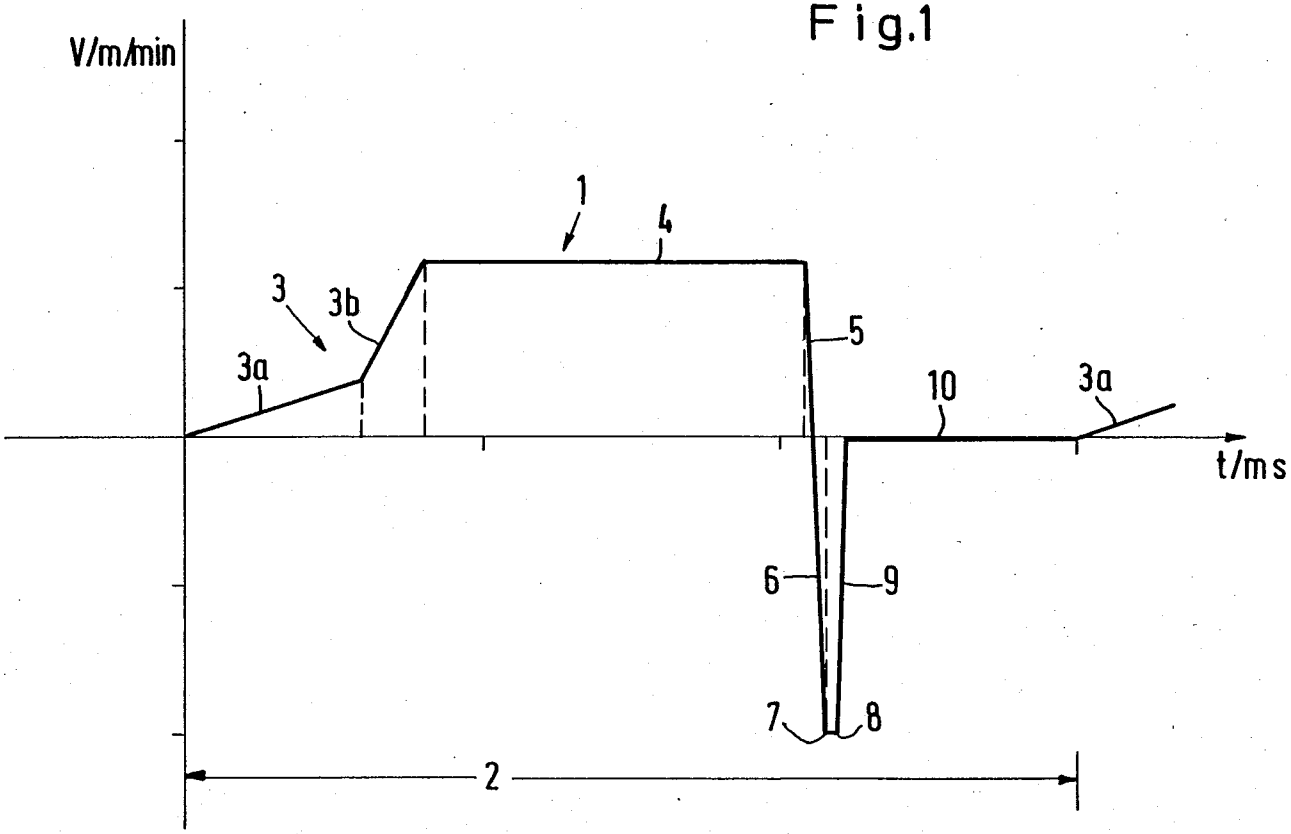
FIG. 1 is a speed versus time diagram for a bracket or bracket pair in longitudinal direction the equivalent to the speed of the casting itself, covering a single extraction cycle.

Proceeding now to the detailed description of the drawings, the diagram of FIG. 1 has plotted along the ordinate the extraction speed in meters/minute, and time in milliseconds is plotted along the abscissa. The trace 1 includes a complete cycle 2 encompassing an extraction, phase a retraction or push back phase, and a holding period. As stated above, the complete cycle time 2 may be for 0.1 to 1.0 seconds. The extraction movement begins with a adjustable acceleration phase 3, including an initial, rather gradual acceleration 3a which is followed by a rather steep increase 3b. There follows then a phase 4 of constant speed and thereafter occurs a deceleration phase 5 having a rather steep decline and ends the forward stroke. No holding period is interposed but as the speed traverses the value 0, the movement immediately reverses thereby beginning a retraction phase 6. This reversal amounts to a rather steep acceleration in the opposite direction until a fairly high speed level 7 is reached. Constant speed here lasts only for a very short period of time, and immediately a deceleration phase 9 brakes the retraction/upsetting while the casting stops when the trace 9 reaches zero speed. There follows then a holding period 10 at the end of which another acceleration 3a marks the beginning of a new cycle.

Figure 2:
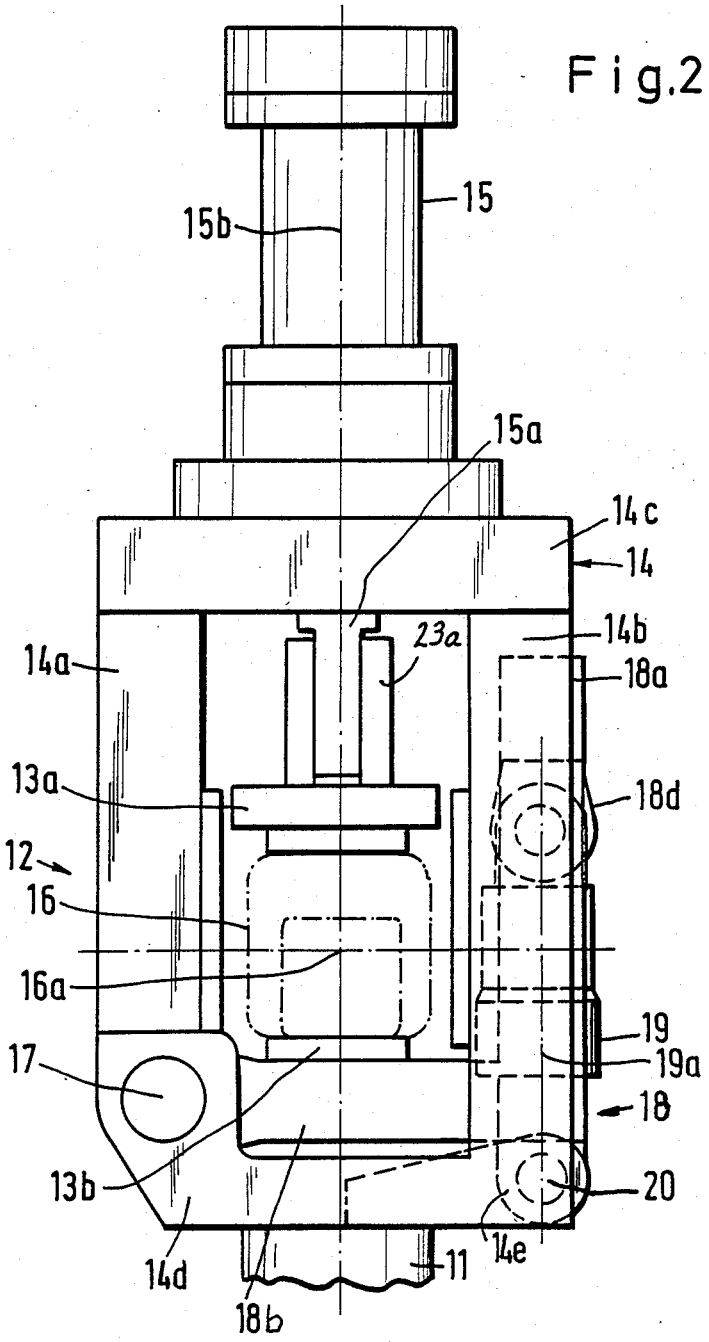
FIG. 2 is a view of an extraction device as seen in the direction of casting.
Figure 3:
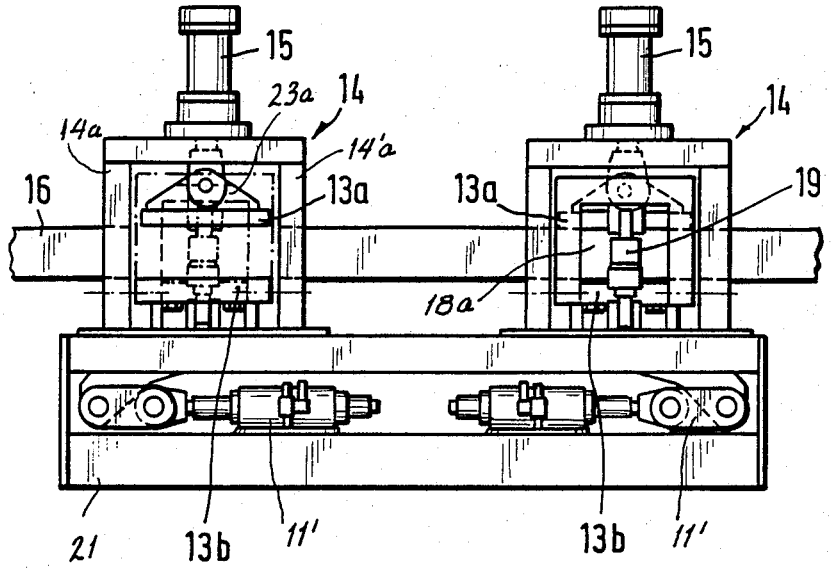
FIG. 3 is a side view of the device shown in FIG. 2.

The extraction device shown in FIGS. 2 and 3 include two carriages 11, each carrying a clamping structure 12 which includes in each instance a pair of clamping brackets, there being upper clamps 13a and lower clamps 13b, accordingly. Each carriage 11 is moved and reciprocated through a drive such as 11', there being two drives accordingly mounted in stationary equipment 21.

Each clamping device 12 includes a carrying frame 14 with upright legs 14*a* and 14*b*, an upper traverse or yoke element 14*c*, and a lower traverse or yoke element 14*d*. A piston cylinder unit 15 and a piston rod 15a is mounted on top of the upper traverse 14*c*. The upper bracket 13a is pivotally linked to the piston rod 15*a*. An angle lever 18 is pivotably mounted to the lower traverse 14*d*, having a pivot axis which runs parallel to the axis of casting 16*a* which can also be regarded as the center axis of the casting strand when in proper position in relation to the axis of casting.

The lever 18 has a first angle arm 18a which is situated next to the casting 16. An angle corner element 18*b* of lever 18 serves as a stop and bracket position defining element. The lower clamping bracket 13*b* is connected to the lever 18 and is placed into a particular plane. The casting 16 rests on the bracket and is situated with its lower end in that plane and will have its axis coincide with the axis 16a of casting. One should add here that the same plane is also defined by the lower inner wall of the mold for continuous casting.

A second piston cylinder unit 19 is linked to the leg 18*a* of lever 18 by means of an eye element 18*d*. As far as the opposite connection of the unit 19 is concerned, there is a corresponding eye 14*e*. This eye 14*e* is connected to the lower traverse 14*d* for connection to the mount 20 of unit 19.

In case of a multi strand casting machine, it is of advantage to have the piston cylinder unit 15 and 19 arranged in parallel, particularly as far as the respective longitudinal axes 15*b* and 19*a* of piston action are concerned. This is a significantly space saving feature, as far as lateral dimensions are concerned.

Inside of each cylinder unit 15 and 19 and actually being a part of each of the piston cylinder unit 15 and 19, is arranged a tracking device which signals, in terms of electrical clocking or counting pulses, very accurately the displacement in the respective cylinder and the piston rod. This tracking device may operate by sensing actual positions of the piston and bracket in each instance. A respective desired value is part of (e.g. programmed into) a microprocessor which controls the timing and driving of the piston cylinder drives.

The clamping device 12 in each instant and particularly the clamping brackets 13a and 13b of a pair are movable along a path having a length which corresponds to the length of extraction of about three extraction cycles 2. Two juxtaposed brackets of the two clamping devices shown alternately grip the casting 16 whereby one bracket pair takes over the casting from the respective other pair one during a period which corresponds to three lifting strokes. Each clamping device is engaged with the casting for whole cycles 2.

The invention is not limited to the embodiments described above, but all changes and modifications thereof, not constituting departures from the spirit and scope of the invention are intended to be included.

We claim:

1. Method for horizontal casting of metal, particularly steel, with stepwise extraction of the casting from a mold whereby each cycle includes such an extraction phase followed by a slight retraction with a holding period interposed between any such retraction phase and the respective next following extraction, the holding period being at least 0.01 sec but not more than half a second, comprising the steps of:

controlling extraction to have an adjustable acceleration phase followed by a phase of constant speed, followed, in turn, by a steep deceleration pahse merging directly into the retraction phase, whereby the cycle time is not smaller than 0.15 sec, but not more than about 1.0 sec, the length of the extraction phase being adjustable in steps of 0.10 mm length in each step.

2. Method as in claim 1 and including vertically oriented clamping bracket pairs wherein the brackets of each pair are independently movable, and further including the step of selectively controlling lifting and lowering of the brackets of a pair independently from each other but in unison during alternating clamping and release-holding phases.

3. Method as in claim 1 wherein the displacement of a clamping bracket pair along the direction of casting is at least three times the length of an extraction stroke.

4. Method as in claim 1 wherein acceleration phase has a first more gradual portion followed by a steeper portion.

* * * * *